US007271776B2

(12) United States Patent
Le Bolzer et al.

(10) Patent No.: US 7,271,776 B2
(45) Date of Patent: Sep. 18, 2007

(54) DEVICE FOR THE RECEPTION AND/OR THE TRANSMISSION OF MULTIBEAM SIGNALS

(75) Inventors: Françoise Le Bolzer, Rennes (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 58 days.

(21) Appl. No.: 10/433,170

(22) PCT Filed: Nov. 30, 2001

(86) PCT No.: PCT/EP01/13991

§ 371 (c)(1),
(2), (4) Date: May 30, 2003

(87) PCT Pub. No.: WO02/47205

PCT Pub. Date: Jun. 13, 2002

(65) Prior Publication Data

US 2004/0217911 A1 Nov. 4, 2004

(30) Foreign Application Priority Data

Dec. 5, 2000 (FR) ..... 00 15715

(51) Int. Cl.
*H01Q 13/10* (2006.01)

(52) U.S. Cl. ..... 343/767; 343/770

(58) Field of Classification Search ..... 343/700 MS, 343/767, 795, 770, 729, 797
See application file for complete search history.

(56) References Cited

U.S. PATENT DOCUMENTS 5,714,961 A * 2/1998 Kot et al. ..... 343/769
6,246,377 B1 * 6/2001 Aiello et al. ..... 343/770
6,366,254 B1 * 4/2002 Sievenpiper et al. ..... 343/770

FOREIGN PATENT DOCUMENTS

| | | |
|---|---|---|
| CA | 2210080 | 1/1999 |
| EP | 477951 | 4/1992 |
| EP | 0685901 A2 | 12/1995 |
| FR | 2785476 | 5/2000 |
| JP | 1-147901 | 6/1985 |
| JP | 7-336134 | 5/1995 |
| JP | 9-246849 | 9/1997 |
| JP | 9-9326602 | 12/1997 |
| WO | 01/13465 | 2/2001 |

OTHER PUBLICATIONS

M.J. Vaughan et al: "28 GHZ Omni-Directional Quasi-Optical Transmitter Array", IEEE Transactions on Microwave Theory and Techniques, IEEE Inc. New York, US, vol. 43, No. 10, Oct. 1, 1995, pp. 2507-2509.
Search Report dated Mar. 18, 2002.

* cited by examiner

*Primary Examiner*—Michael C. Wimer
(74) *Attorney, Agent, or Firm*—Joseph J. Laks; Robert D. Shedd; Brian J. Cromarty

(57) ABSTRACT

The present invention relates to a device for the reception and/or the transmission of multibeam signals of the type comprising:

a set of several means of receiving and/or transmitting waves with longitudinal radiation of the slot printed antenna type, the said means being disposed so as to receive an azimuthally wide sector, means able to connect in reception one of the said receiving and/or transmitting means to means for utilizing the multibeam signals.

This device moreover comprises means able to connect in transmission the set of the said receiving and/or transmitting means to the said means for utilizing the multibeam signals. The invention applies more particularly to the field of wireless transmissions.

13 Claims, 11 Drawing Sheets

DEVICE FOR THE RECEPTION AND/OR THE TRANSMISSION OF MULTIBEAM SIGNALS

This application claims the benefit, under 35 U.S.C. § 365 of International Application PCT/EP01/13991, filed Nov. 30, 2001, which was published in accordance with PCT Article 21(2) on Jun. 13, 2002 in English and which claims the benefit of French patent application No. 0015715, filed Dec. 5, 2000.

BACKGROUND OF THE INVENTION

The present invention relates to a device for the reception and/or the transmission of multibeam signals which are useable more especially in the field of wireless transmissions.

In the known systems for high-throughput wireless transmissions useable in particular in a domestic environment, the signals sent by the transmitter reach the receiver along a plurality of distinct paths. This results at the level of the receiver in interference liable to cause fadeouts and distortions of the signal transmitted and consequently a loss or a degradation of the information to be transmitted. To remedy this drawback, directional antennas of the horn, reflector or array type are usually used, these antennas being used at the transmitting and/or receiving end and making it possible to combat or attenuate the degradations related to multipaths. Specifically, in addition to the gain afforded by the directional antenna, the latter makes it possible by spatial filtering, on the one hand to reduce the number of multipaths, and hence to reduce the number of fadeouts, and on the other hand to reduce the interference with other systems operating in the same frequency band.

Since directional antennas do not allow for significant azimuthal spatial coverage, French Patent Application No. 98 13855 filed in the name of the applicant has therefore proposed a compact antenna making it possible to increase the spectral efficiency of the array by reusing the frequencies by virtue of a segmentation of the physical space to be covered by the radiation pattern of the sectorial antenna. The antenna proposed in the above patent application consists of a coplanar circular arrangement about a central point of Vivaldi-type printed radiating elements making it possible to present several directional beams sequentially over time, the set of beams giving complete 360° coverage of space.

Whereas this type of antenna makes it possible to obtain good operation of the receiving device, it is often advantageous in transmission to be able to obtain omnidirectional coverage of space, for example when the transmitter system must be able to declare itself to all the users or transmit to several receivers.

The aim of the present invention is therefore to propose a device for the reception or the transmission of multibeam signals making it possible to meet this need.

SUMMARY OF THE INVENTION

Consequently the subject of the present invention is a device for the transmission and/or the reception of multibeam signals of the type comprising:

- a set of several means of receiving and/or transmitting waves with longitudinal radiation of the slot printed antenna type, the said means being disposed so as to receive an azimuthally wide sector,
- means able to connect in reception one of the said receiving and/or transmitting means to means for utilizing the multibeam signals,

- characterized in that it moreover comprises means able to connect in transmission the set of the said receiving and/or transmitting means to the said means for utilizing the multibeam signals.

According to one embodiment, the means able to connect in transmission the set of the said receiving and/or transmitting means consist of a microstrip line or a coplanar line crossing the set of slots of the slot printed antennas constituting the receiving and/or transmitting means, the length of the line between two slots being equal, at the central frequency of operation of the system, to $k\lambda m/2$ and the length of the line between one end of the line and a slot being equal to $\lambda m/4$ where $\lambda m=\lambda 0/\sqrt{\epsilon reff}$. (with $\lambda 0$ as wavelength in vacuo and $\epsilon reff$. the effective relative permittivity of the line) and k is an integer. Preferably, the length of the line between two slots is equal to $k\lambda m$ so as to obtain in-phase operation of the printed antennas.

In this case, the crossover between the slot of the slot printed antenna and the line is preferably effected, at the central frequency of operation of the system, at a distance $k'\lambda s/4$ from the closed end of the slot with $\lambda s=\lambda 0/\sqrt{\epsilon 1 reff}$. ($\lambda 0$ the wavelength in vacuo and $\epsilon 1 reff$. the equivalent relative permittivity of the slot) and k' an odd integer. Preferably, the line is connected by one of its ends to the means for utilizing the multibeam signals.

According to another embodiment, the connection of the line to the means for utilizing the multibeam signals is effected on a line part between two slots at a distance $k\lambda m/2$ from one of the slots.

According to a further characteristic of the present invention, the means able to connect in reception one of the said receiving and/or transmitting means to the means for utilizing the multibeam signals consist of a portion of microstrip line or of coplanar line, each portion crossing the slot of one of the slot printed antennas and being linked to the means for utilizing the multibeam signals by a switching device. Preferably, the crossover of each portion of line and of the slot of the slot printed antenna is effected, at the central frequency of operation of the system, at a distance $k'\lambda s/4$ from the closed end of the slot with $\lambda s/4=\lambda 0/\sqrt{\epsilon 1 reff}$. ($\lambda 0$ the wavelength in vacuo and $\epsilon 1 reff$. the equivalent relative permittivity of the slot) and k' an odd integer.

When this embodiment of the means of connection in reception is associated with the embodiment described above of the means of connection in transmission, the distance between n transmission lines constituting the means of connection in transmission and the portion of transmission lines constituting the means of connection in reception is equal, at the central frequency of operation of the system, to $k''\lambda s/2$ with $\lambda s=\lambda 0/\sqrt{\epsilon 1 reff}$. ($\lambda 0$ the wavelength in vacuo and $\epsilon 1 reff$. the equivalent relative permittivity of the slot) and k" an integer.

According to a preferred embodiment, each slot printed antenna is formed by a substrate comprising on a first face at least one excitation microstrip line coupled to a slot line etched on the second face. Preferably, the slot line flares progressively up to the edge of the substrate, the antenna being a Vivaldi-type antenna. The set of antennas constituting the means of receiving and/or transmitting waves with longitudinal radiation is regularly disposed about a single and coplanar point in such a way as to be able to radiate in a 360° angle sector.

BRIEF DESCRIPTION OF THE DRAWINGS

Other characteristics and advantages of the present invention will become apparent on reading the description of various embodiments, this description being given hereinbelow with reference to the appended drawings in which.

To simplify the description, in the figures the same elements bear the same references.

DESCRIPTION OF PREFERRED EMBODIMENTS

Figure 1:
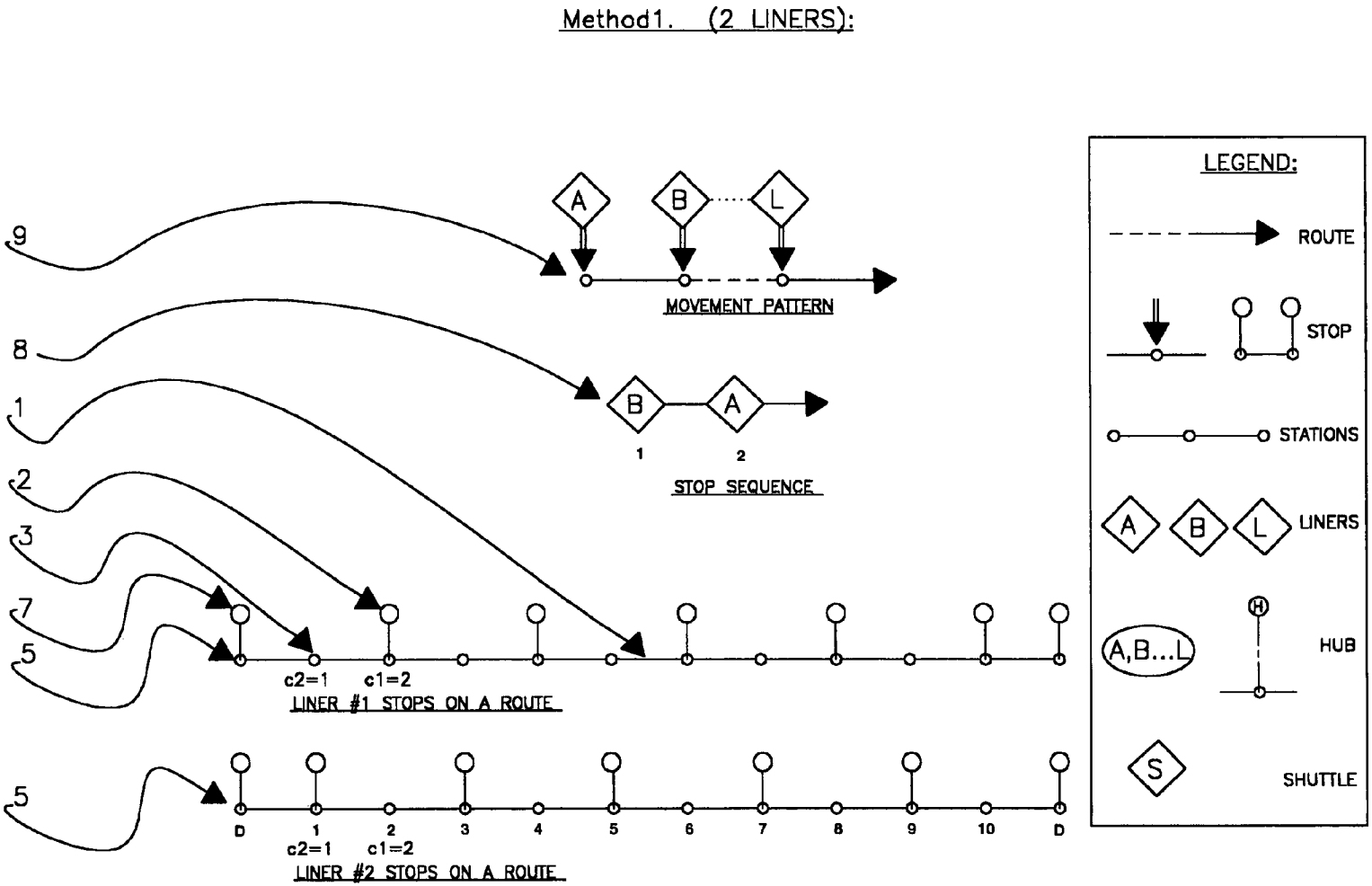
FIG. 1 represents a diagrammatic view of a device according to a first embodiment of the invention.

Represented diagrammatically in FIG. 1 is a compact antenna of the type described in French Patent Application No. 98 13855. To receive on an azimuthally wide sector, the means of reception and/or transmission with longitudinal radiation consist of four slot printed antennas 1*a*, 1*b*, 1*c*, 1*d* regularly spaced around a central point 2. As represented diagrammatically in FIG. 1, the slot antennas comprise a slot-line 1'*a*, 1'*b*, 1'*c*, 1'*d* flaring progressively from the centre 2 to the end of the structure, in such a way as to constitute a Vivaldi-type antenna. The structure and the performance of the Vivaldi antenna are well known to those skilled in the art and are described in particular in the documents "IEEE Transactions on Antennas and Propagation" by S. Prasad and S. Mahpatra, Volume 2 AP-31 No. 3, May 1983 and "Study of Discontinuities in open waveguide—application to improvement of radiating source model" by A. Louzir, R. Clequin, S. Toutin and P. Gélin, Lest Ura CNRS No. 1329.

As represented in FIG. 1, the four Vivaldi antennas 1*a*, 1*b*, 1*c*, 1*d* are positioned perpendicularly to one another on a common substrate (not represented). In accordance with the present invention and as represented in FIG. 1, the four antennas 1*a*, 1*b*, 1*c* and 1*d* are linked together by way of a microstrip line 3, this microstrip line making it possible to produce line/slot transitions and positioned in such a way that the length of line between two slots such as 1'*c*–1'*b*, 1'*b*–1'*a* or 1'*a*–1'*d* is equal, at the central frequency of operation of the system, to k(λm/2), preferably kλm/4 in which λm=λ0/$\sqrt{\epsilon}$reff. with λ0 the wavelength in vacuo and ϵreff. the equivalent relative permittivity of the microstrip line. Moreover, to obtain correct operation in omnidirectional mode, the end of the microstrip line 3 is at a distance k'λm/4 from the closest slot 1'*d*, k' being an odd integer and λm being given by the above relation. The other end of the microstrip line is connected in transmission to means for transmitting signals of known type, comprising in particular a power amplifier. When the slots of the Vivaldi antennas are fed by a microstrip line exhibiting a length λm or kλm, as represented in FIG. 1, in-phase operation of the antennas is obtained, this giving an optimal radiation pattern, as represented in FIG. 1 by the arrows E representing the radiated electric field.

The principle of operation of the device of FIG. 1 will now be explained more particularly with reference to FIGS. 2 to 7.

Figure 2:
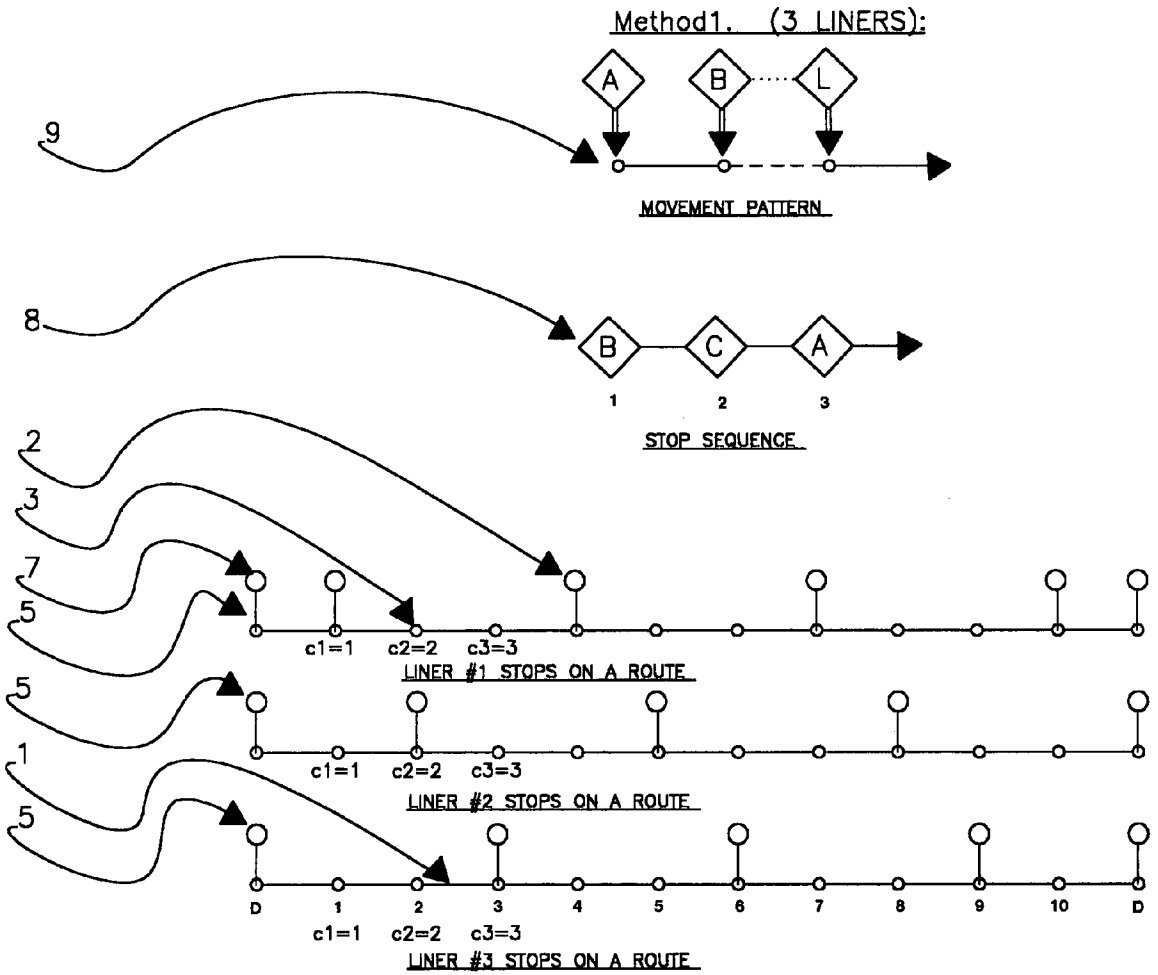
FIG. 2 represents a diagrammatic view of a line/slot transition making it possible to explain the operation of the device of FIG. 1.
Figure 3:
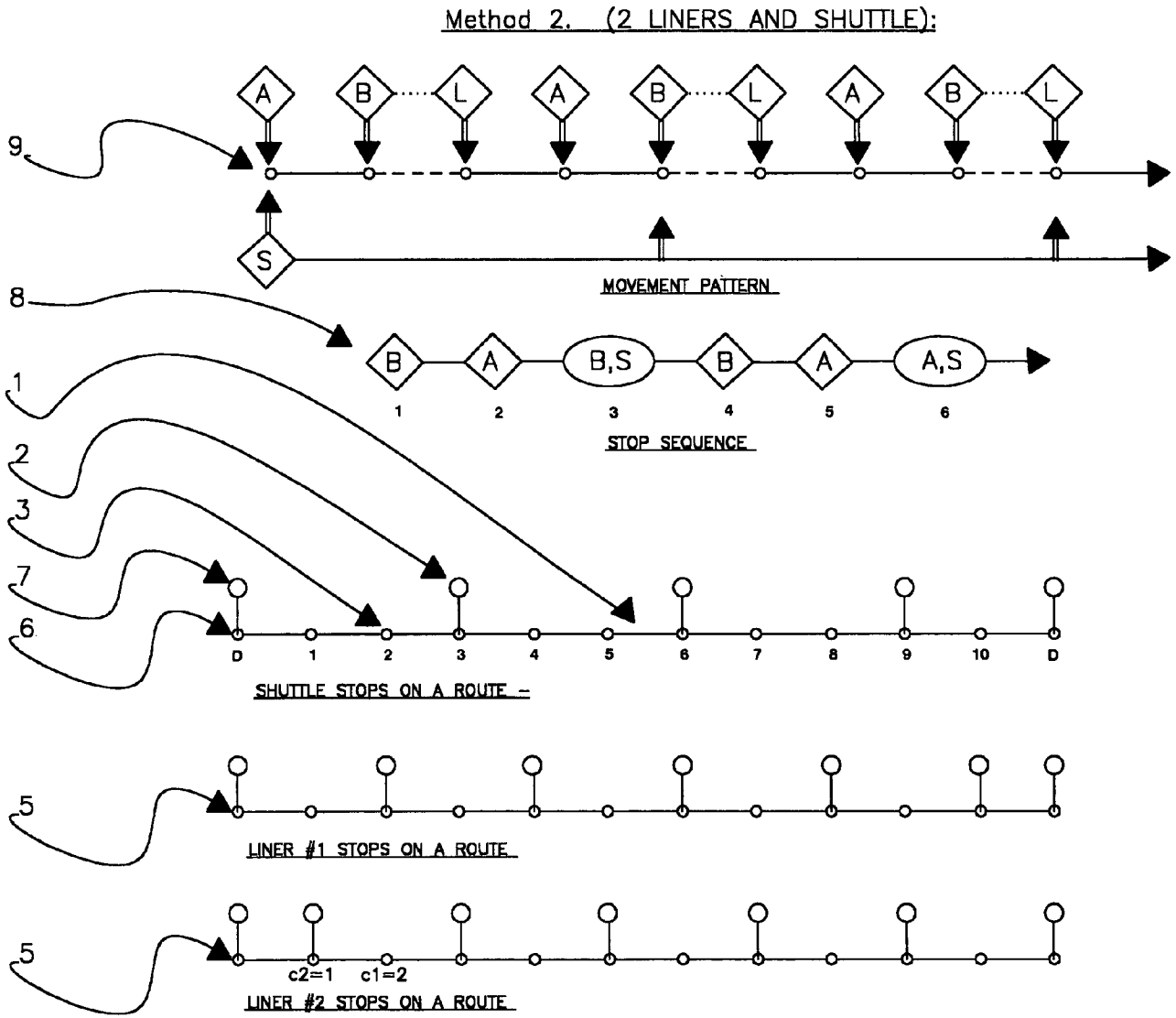
FIG. 3 represents the equivalent electrical diagram of the transition represented in FIG. 2.

As described hereinabove, the feeding of the Vivaldi antennas relies on the use of a transition between a microstrip line and a slot, more especially on a transition between a microstrip line and several slots in series. Represented in FIG. 2 is the transition of a microstrip line 10 with two slots 11, 12. In the case of FIG. 2, the microstrip line 10 is fed by a generator 13 and the slots 11 and 12 are positioned so that their short-circuited end cc lies at a distance λs2/4 and λs1/4 respectively or more generally an odd multiple of λs2/4 and λs1/4. Moreover, the distance between two successive slots is chosen to be equal to a multiple of half the wavelength, namely kλm/2, so as to lie in one and the same phase plane to within 180°, for each transition. Moreover, as represented in FIG. 2, the slot 12 is positioned at a distance λm/4 or k'λm/4 (k' odd) from the end of the microstrip line. All the values λs/4, λs2/4, λs1/4 and λm/2 are valid at the central frequency of operation of the system. A line/slot transition exhibits a general equivalent diagram as represented in FIG. 3.

This equivalent diagram is obtained from the equivalent diagram of a simple transition between a microstrip line and a slot line proposed for the first time by B. Knorr. It consists of the impedance $Z_s$ corresponding to the characteristic impedance of the slot line 11 in parallel with a self-inductive reactance of value $X_s$ (corresponding to the end effect of the short circuit terminating the slot line) brought back by a line of characteristic impedance $Z_s$ and of electrical length $\theta_s$ corresponding to the slot line quarter-wave stub (length $\lambda_{s1}/4$). The assembly is linked to an impedance transformer of transformation ratio N:1. To the other branch of the impedance transformer is linked in series a capacitive reactance $X_m$ (corresponding to the end effect of the open circuit terminating the microstrip line) brought back by a line of characteristic impedance $Z_m$ and of electrical length $\theta_m$ corresponding to the microstrip line quarter-wave stub (length $\lambda_{m1}/4$), with a microstrip line of characteristic impedance $Z_m$ and of electrical length $\theta_{m1}$ corresponding to the microstrip line of length $k\lambda_m/2$. This line is linked to another impedance transformer of transformation ratio 1:N linked to the equivalent circuit corresponding to the second slot line quarter-wave stub (length $\lambda_{s2}/4$) and to the slot line 12. The assembly is linked to a generator 13 situated at the tip of the exciter microstrip line.

In this type of circuit, when it operates near resonance, namely when the microstrip line lengths and the lengths between the microstrip line and the end of the slots are equal to λm/4 and λs/4 respectively, the equivalent circuit of the line is transformed into a short-circuit while the equivalent circuit of the slot Xs is transformed into an open circuit. Therefore, the equivalent circuit becomes a circuit such as that represented in FIG. 4 and in which there now remains only the generator 13, the resistors 131, 132 provided on the two output terminals of the generator 13, a first transformer 133 of ratio 1/N on which the resistor Zs is mounted and a second transformer 135 of ratio 1/N across the output terminals of which is mounted an impedance Zs. It is therefore apparent that the juxtaposition of the slots on a microstrip line is equivalent to a series arrangement of the impedances Z1 and Z2, etc., exhibited by the various transitions. In the case of identical transitions, there is an equal power distribution on each of the excited slots. This mode of operation consequently ensures a feeding of the various Vivaldi antennas in such a way as to obtain omnidirectional radiation.

Figure 5:
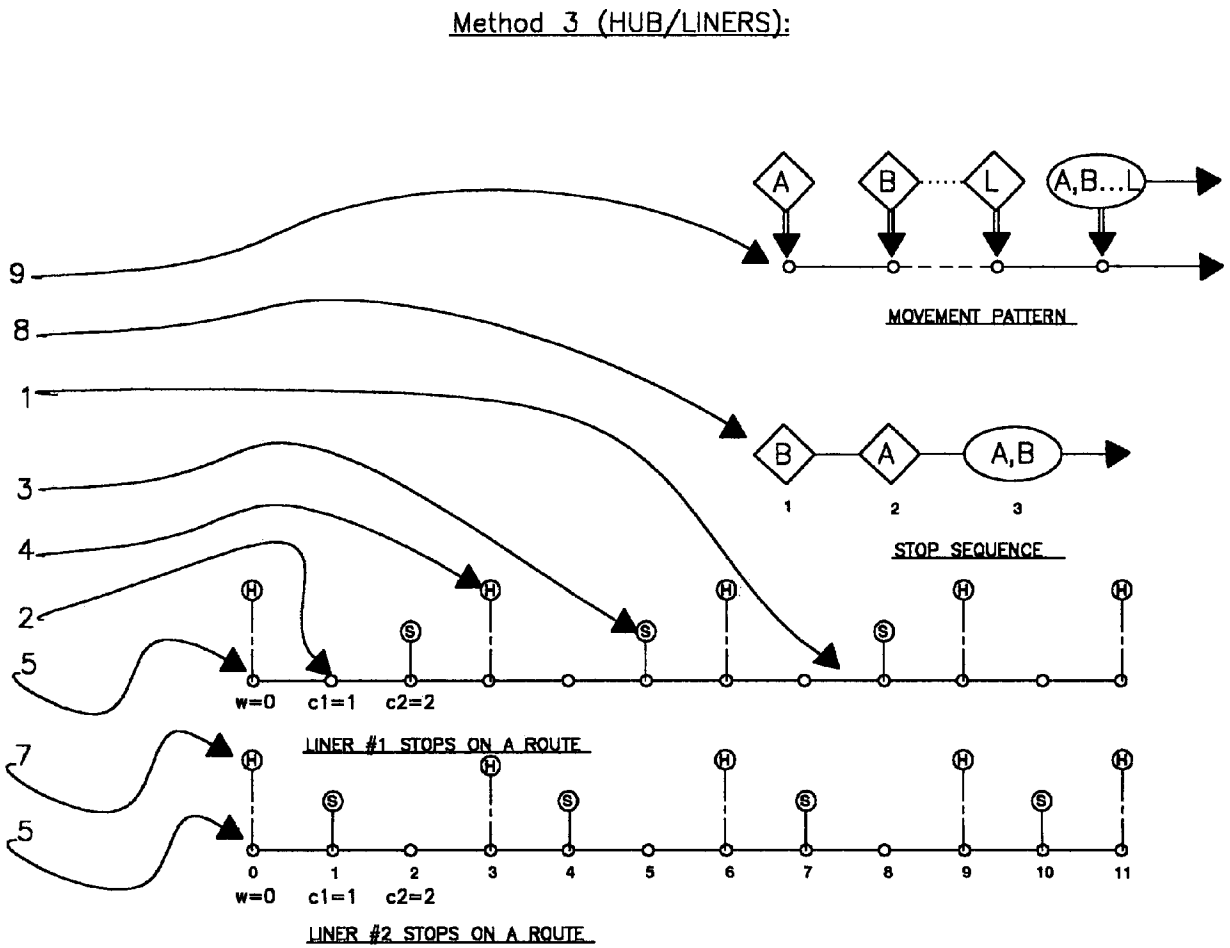
Figure 5:
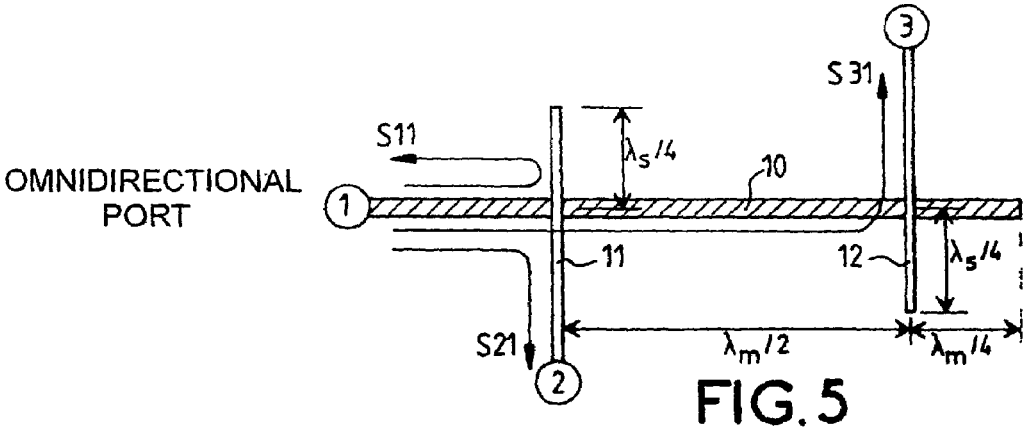

The principle of operation of a device in accordance with the present invention has been simulated with the aid of a circuit such as represented in FIG. 5. This circuit comprises a microstrip line 10 fed at ①. At a length λm/4 from the end, the line 10 cuts a slot 12 belonging to a Vivaldi-type antenna. This slot can be accessed via the access ③. As described above, the end of the slot 12 lies at a distance λs/4 from the microstrip line. As represented in FIG. 5, at a distance λm/2 from the slot 12 is made another slot 11 constituting an element of a second Vivaldi antenna. This slot can be accessed via the access ②. Moreover, the end of the slot lies at a distance λs/4 from the microstrip line. The ports ② and ③ as represented in FIG. 5 make it possible to visualize the energy recovered on the various Vivaldi-type antennas.

Figure 6:
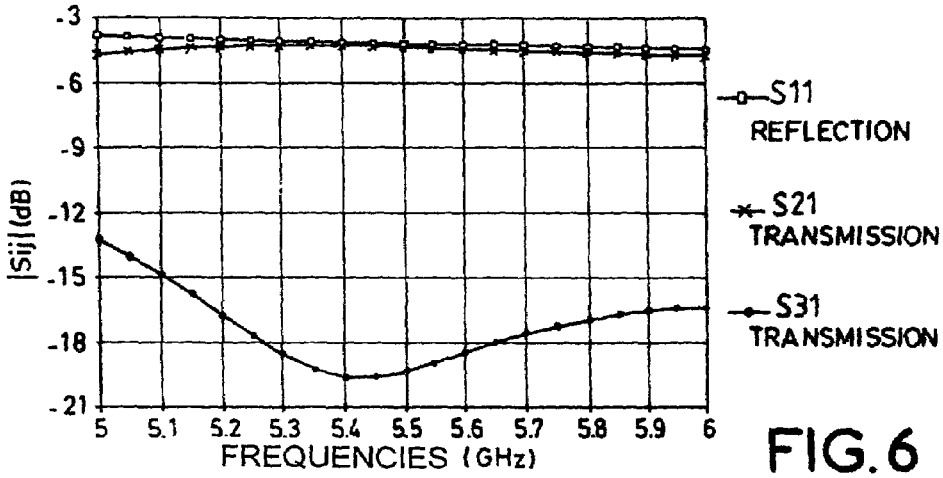
Figure 7:
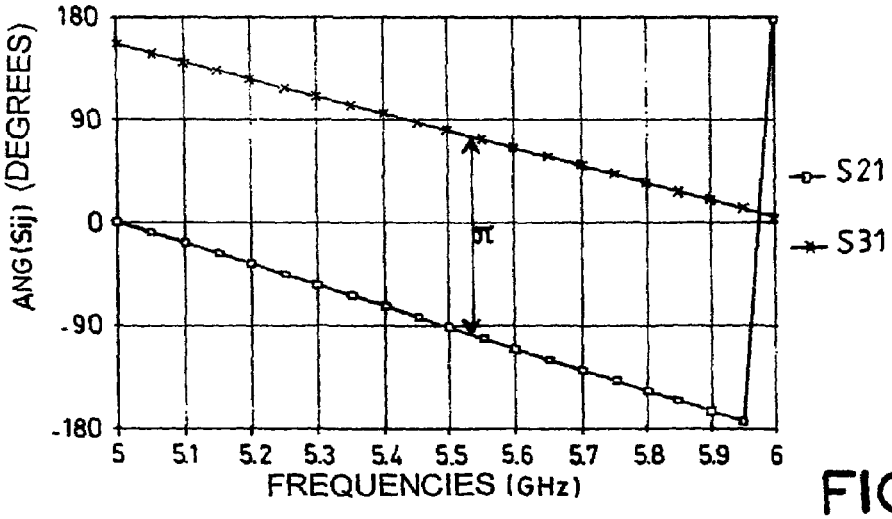

As represented in the curves of FIGS. 6 and 7, it may be seen that the signal transmitted on the microstrip line feed access ① is correctly transmitted to the various slots. Specifically, the coefficient of reflection symbolized by the arrow S11 is less than −16 dB throughout the band lying between 5.2 and 6 GHz. Moreover, the distribution of power to the access ways ② and ③ is well balanced since the coefficients of transmission S21 and S31 are substantially the same, as represented in FIG. 6, by the two top curves. Moreover, represented in FIG. 7 is the phase of the signals recovered on the access ways ② and ③. A phase shift of Π which corresponds to the distance λm/2 separating the two slots 11 and 12 may be observed in the figure.

Figure 8:
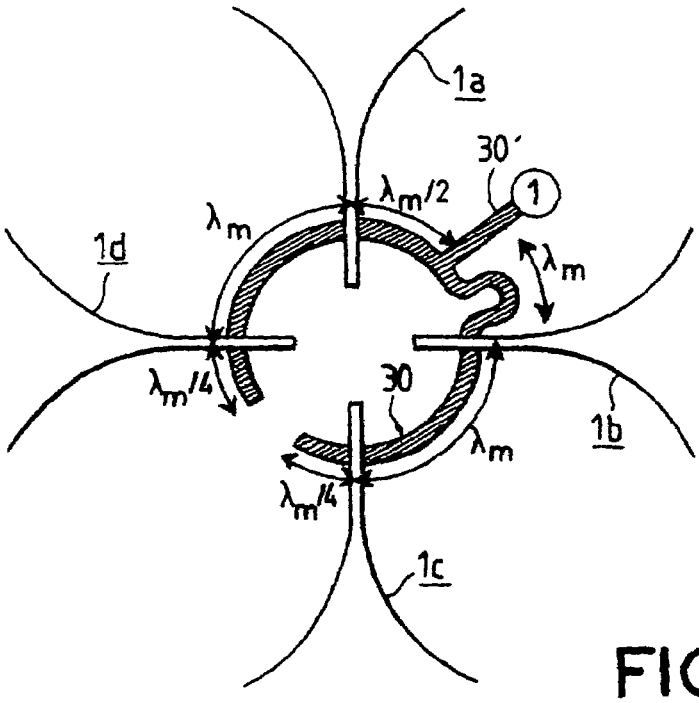
FIG. 8 represents a diagrammatic view of a device according to a second embodiment of the invention.

Represented in FIG. 8 is a variant of the device of FIG. 1 in accordance with the present invention. In this case, the microstrip line 30 is not connected by one of these ends to the means for utilizing the signals as in the case of FIG. 1. The microstrip line is connected by a microstrip line segment 30' provided, for example, between the antenna 1*a* and the antenna 1*b*. To allow phase matching of the two Vivaldi-type antennas 1*a* and 1*b*, the line part 30' lies at a distance λm/2 from one of the antennas, namely the antenna 1*a* and at a distance λm from the other antenna, namely the antenna 1*b* in the embodiment represented. It is obvious to the person skilled in the art that multiple values of λm/2 and of λm may also be used. In this case, the two ends of the microstrip line 30 crossing the four Vivaldi antennas 1*c*, 1*b*, 1*a*, 1*d* lie at a distance λm/4, preferably k'λm/4 with k' odd from the corresponding Vivaldi antenna, namely the antenna 1*c* and the antenna 1*d* in the embodiment represented. With a structure such as represented in FIG. 8, operation of the same type as that described in respect of a structure such as that represented in FIG. 1 is obtained.

Figure 9:
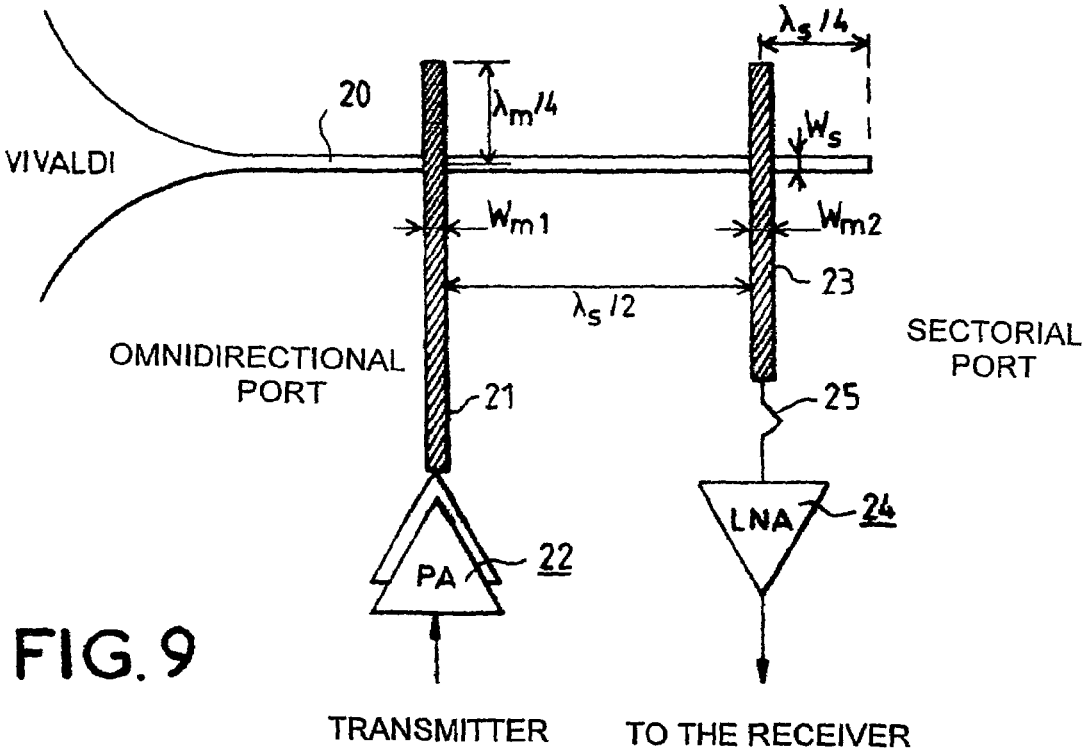
FIG. 9 is a diagrammatic view of a slot/two line transition making it possible to operate the devices of FIGS. 1 and 9 in omnidirectional and sectorial modes, FIGS. 10 and 11 diagrammatically represent the topology of the circuit of FIG. 9 operating in transmission, and the curves giving the level of the signal as a function of frequency on/the various access points in omnidirectional mode.

A further characteristic of the present invention making it possible to connect in reception one of the said Vivaldi-type antennas to the means for utilizing the multibeam signals will now be described with reference more particularly to FIGS. 9 to 15. This characteristic consists of an arrangement as represented in FIG. 9, allowing the simultaneous coupling of two microstrip lines with the slot of a Vivaldi antenna. As represented in FIG. 9, the slot 20 of a Vivaldi-type antenna is crossed by a first microstrip line 21 corresponding to the microstrip line described above and allowing operation in omnidirectional mode. Therefore, the end of the microstrip line 21 is connected to the transmitter circuit 22 by way of a power amplifier Pa. As represented in FIG. 9, the end of the microstrip line 21 lies at a distance λm/4 from the slot 20. Although this is not represented in the drawing, the microstrip line 21 also crosses the slots of the other Vivaldi antennas positioned as, for example, in the embodiment of FIG. 1. Moreover, at a distance λs/2 from the microstrip line 21, another portion of microstrip line 23 cuts the slot 20. As represented in FIG. 9, an end of the portion of the microstrip line 23 is connected by way of a switch 25 such as a diode which, depending on its state, can be off or on, to a receiver circuit 24 comprising a low noise amplifier LNA. As represented in FIG. 9, the end of the slot 20 is positioned at a distance λs/4 from the microstrip line 23. In the above embodiment, the distances λs/4 and λs/2 are, at the central frequency of operation of the system, such that $\lambda s=\lambda 0/\sqrt{\epsilon reff}$. with λ0 the wavelength in vacuo and εreff. the equivalent relative permittivity of the slot while $\lambda m=\lambda 0/\sqrt{\epsilon reff}$. with λ0 the wavelength in vacuo and εreff. the equivalent relative permittivity of the microstrip line. The use of a switching circuit associated with the LNA makes it possible in reception to operate in sectorial mode.

Figure 4:
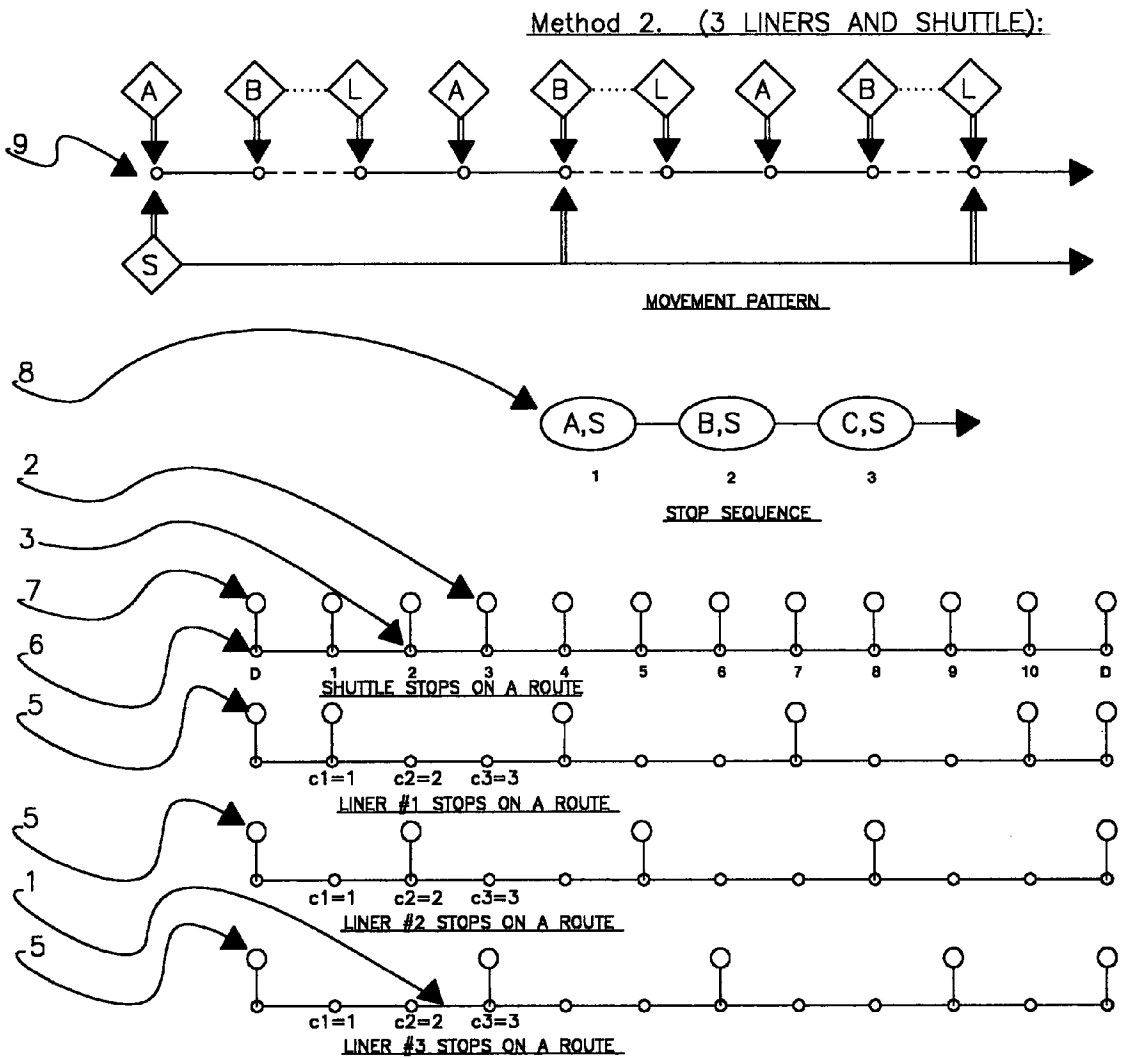
FIG. 4 represents the equivalent electrical diagram of the transition represented in FIG. 2 when the lengths have been matched so as to be at resonance, FIGS. 5, 6 and 7 respectively represent the circuit of a line/slot transition used to simulate the operation of the device of FIG. 1, the level of the signals on various access points as a function of frequency in an omnidirectional mode of excitation and the phase of the signals on the two slot ports in omnidirectional mode of excitation.

An equivalent electrical diagram of the same type as that represented in FIGS. 3 and 4 can be obtained for the topology of FIG. 9 which in fact corresponds to a double transition between a slot and two microstrip lines. In this case, it is apparent that the juxtaposition of lines on a slot is equivalent to a parallel arrangement of the impedances exhibited by the various transitions.

The operation of the circuit of FIG. 9 in transmission and in reception will now be explained more particularly with reference to FIGS. 10, 11, 12 and 13.

Figure 10:
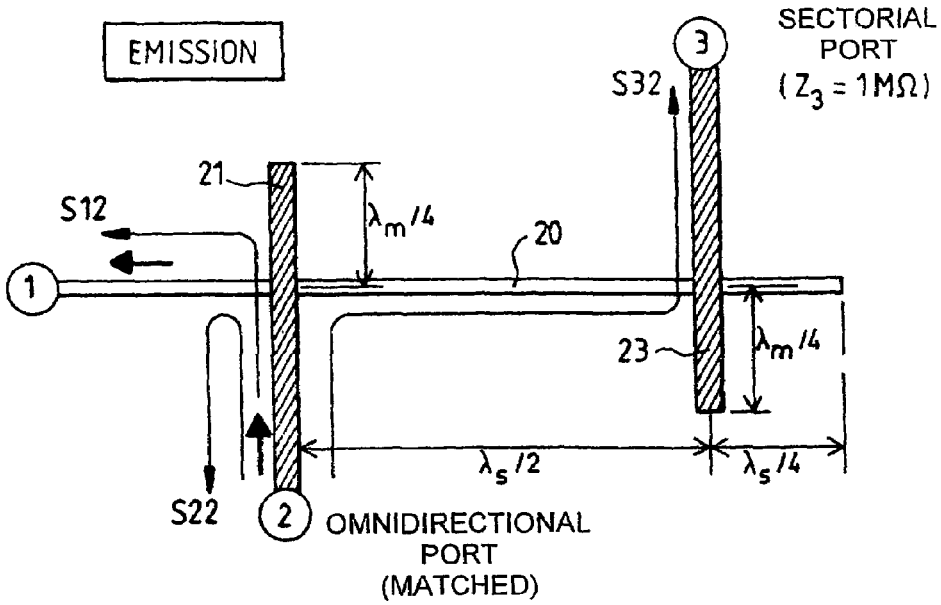

Operation in transmission has been simulated on a configuration as represented in FIG. 10. In transmission, the device in accordance with the present invention operates in omnidirectional mode. In this case, the signals are sent to the microstrip line 21 while the line 23 exhibits at the level of its port a high impedance of around 1 MΩ. The value of the transmission coefficient S12, reflection coefficient S22 and isolation coefficient S32 are represented in FIG. 11, for a frequency varying between 5 and 6 GHz.

Figure 11:
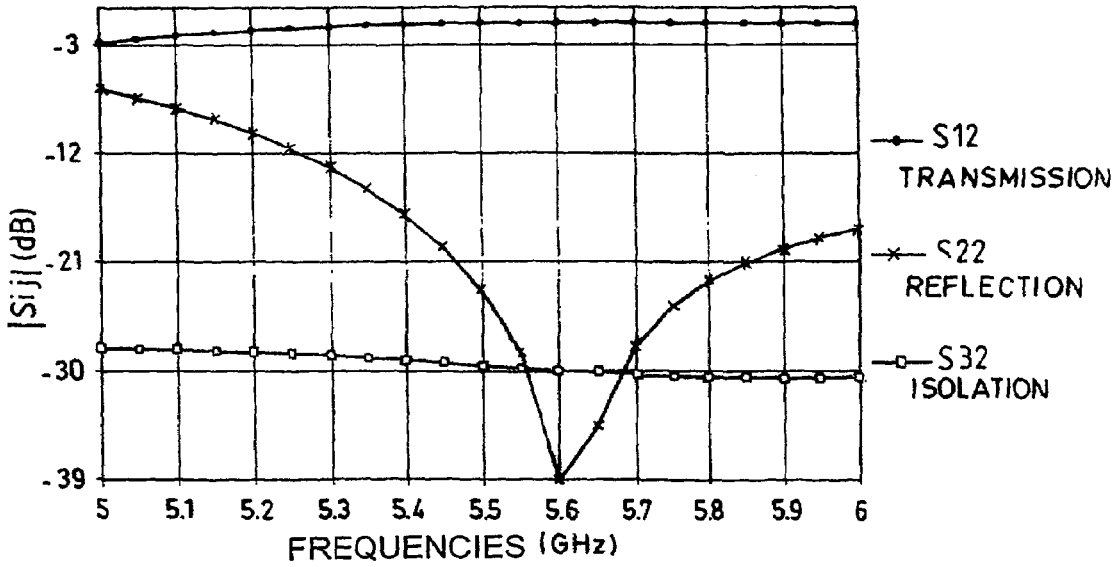

As represented in the curves of FIG. 11, it may be seen that the signal transmitted on the feed access ② of the microstrip line 21 is correctly transmitted to the slot 20. Specifically, the coefficient of reflection symbolized by the arrow S22 remains on the one hand very small since it is less than −10 dB throughout the band lying between 5.2 and 6 GHz. Moreover, the power is distributed well to the access ① since the coefficient of transmission symbolized by S12 is greater than −2 dB over this same band. Finally, no transfer of power occurs to the access ③ since the isolation symbolized by S31 is less than −26 dB.

Operation in reception, namely in sectorial mode, will now be described with reference to FIGS. 12 and 13. In this case, the microstrip line 23 is connected to the receiving circuit by closing the switch 25 and the transmission stage brings back a very high impedance, namely an impedance Z2 of around 1 MΩ on the access to the microstrip line 21. With this type of circuit, one obtains a transmission coefficient S31, reflection coefficient S11 and isolation coefficient S21 as represented in FIG. 13, for a frequency value varying between 5 and 6 GHz.

Figure 12:
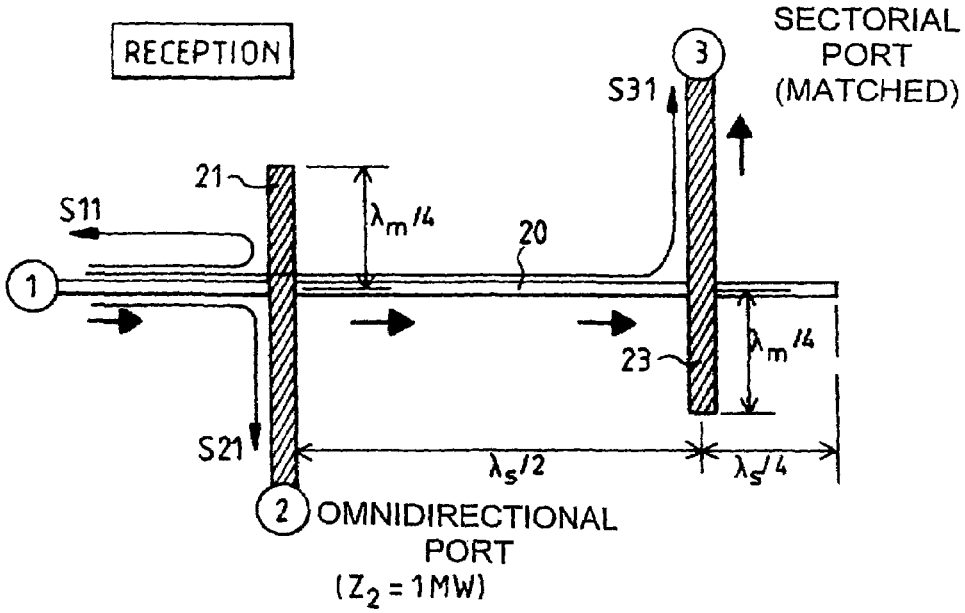
FIGS. 12 and 13 are representations equivalent to FIGS. 10 and 11 in the case of operation in sectorial mode in reception.
Figure 13:
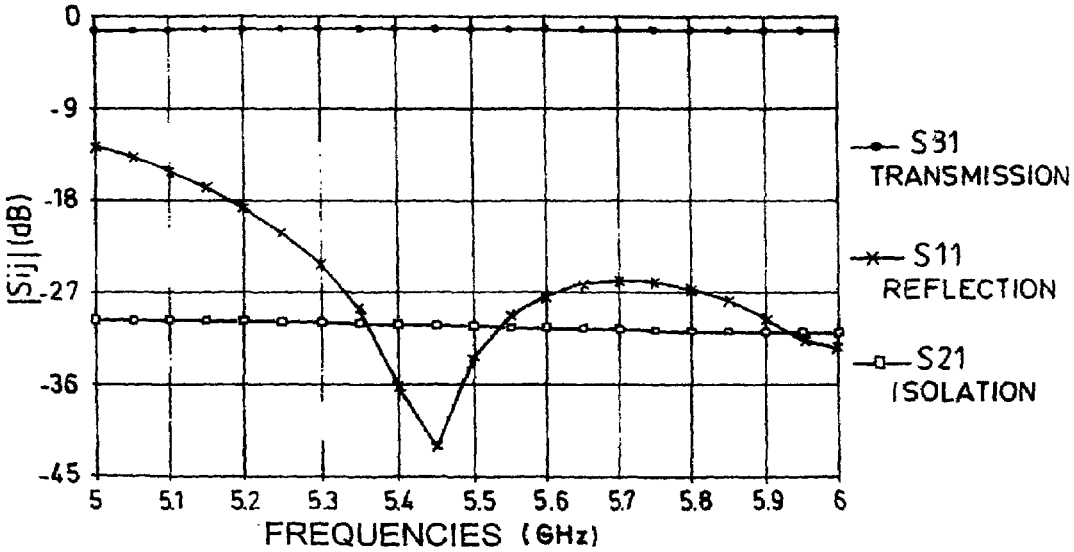

As represented in the curves of FIG. 12, it may be seen that the signal received on the access ① of the slot 20 is transmitted correctly to the microstrip line 23 corresponding to the reception access. Specifically, the coefficient of reflection symbolized by the arrow S11 remains on the one hand very small since it is less than −10 dB throughout the band lying between 5.2 and 6 GHz. Moreover, the power is distributed well to the access ③ since the transmission coefficient symbolized by S31 is greater than −2 dB over this same band. Finally, no transfer of power occurs to the access ③ since the isolation symbolized by S21 is less than −29 dB.

Figure 14:
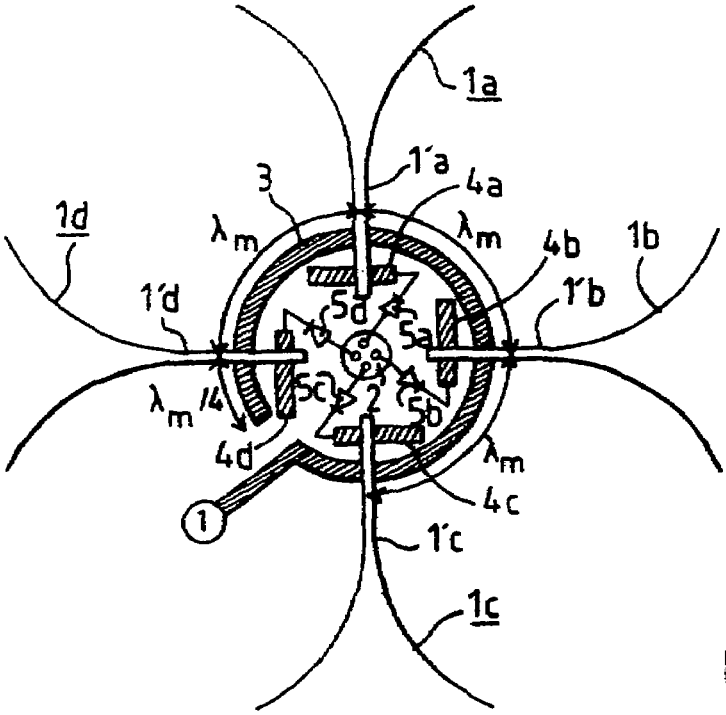
FIGS. 14 and 15 are diagrammatic views of a device according to a third and a fourth embodiment of the present invention.
Figure 15:
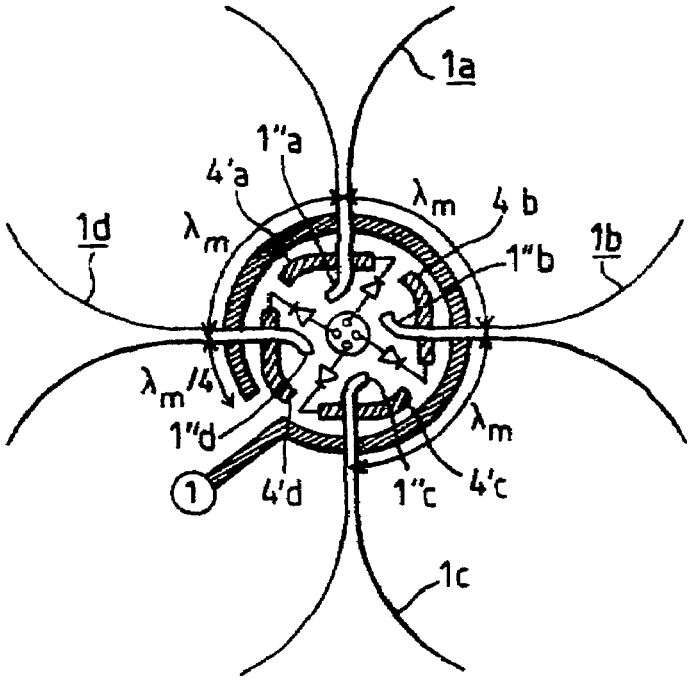

Represented diagrammatically in FIGS. 14 and 15 are two embodiments of a transmission/reception device in accordance with the invention. Just as for FIG. 1, the reception/transmission means consist of four slot printed antennas 1*a*, 1*b*, 1*c*, 1*d*, regularly spaced around a central point. The printed antennas are, just as in FIG. 1, of Vivaldi type. The four Vivaldi antennas are positioned perpendicularly to one another. The slots 1'*a*, 1'*b*, 1'*c*, 1'*d* of the four antennas are linked together by a microstrip line 3 placed as in the embodiment of FIG. 1, in such a way as to allow in transmission operation in omnidirectional mode. Moreover, each slot 1'*a*, 1'*b*, 1'*c*, 1'*d* is crossed by a portion of microstrip line 4*a*, 4*b*, 4*c*, 4*d* linked by a switch 5*a*, 5*b*, 5*c*, 5*d* to the reception circuit, so as to obtain operation in sectorial mode, as explained above. The dimensions and positions of the microstrip lines 3, 4*a*, 4*b*, 4*c* and 4*d* correspond to what was explained above.

The embodiment of FIG. 15 is substantially identical to that of FIG. 14 Simply for reasons of bulkiness, the ends of the slots 1"*a*, 1"*b*, 1"*c*, 1"*d* have been curved inwards as have the portions of microstrip lines 4'*a*, 4'*b*, 4'*c*, 4'*d*.

Figure 16:
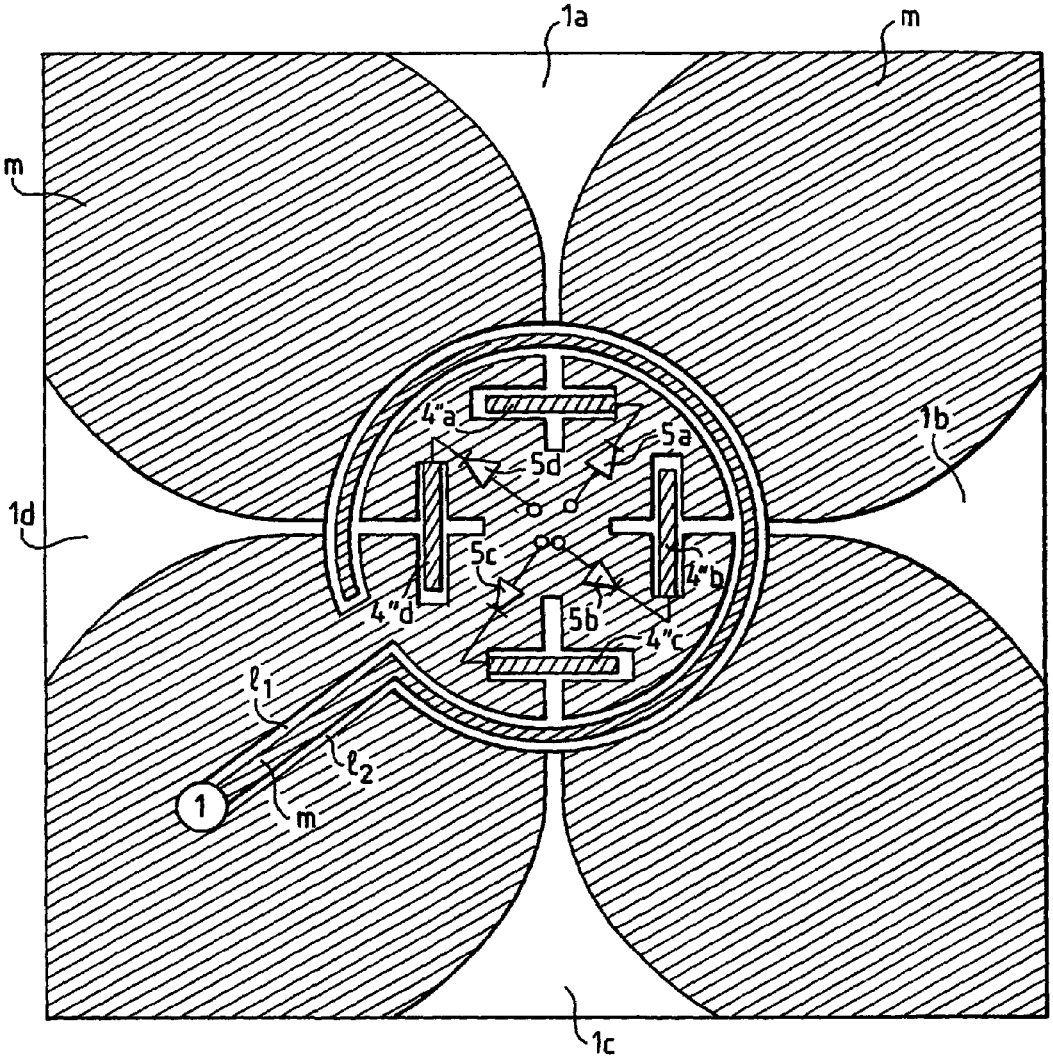
FIG. 16 is a plane view of a fifth embodiment of the invention.

According to another embodiment of a device of the same type as that represented in FIGS. 14 and 15, represented in FIG. 16, the feed line corresponding to the microstrip line consists of a coplanar line exhibiting two slots 11, 12 and a metallization m. In this case, the slot lines 1*a*, 1*b*, 1*c*, 1*d* forming the Vivaldis are separated by metallizations m. Likewise, the line portions consist of coplanar line portions 4"*a*, 4"*b*, 4"*c*, 4"*d* connected by switches 5*a*, 5*b*, 5*c*, 5*d* as in the embodiment of FIGS. 14 and 15. It is obvious to the person skilled in the art that any mixture of the above structures may be envisaged, such as:

- Omnidirectional mode: microstrip line/sectorial mode: microstrip line.
- Omnidirectional mode: coplanar line/sectorial mode: microstrip line.
- Omnidirectional mode: microstrip line/sectorial mode: coplanar line.
- Omnidirectional mode: coplanar line/sectorial mode: coplanar line.

It is obvious to the person skilled in the art that the embodiments described above may be modified, in particular as regards the number of Vivaldi antennas, the type of feed of the structure or the type of switch, etc., without departing from the scope of the claims below.

The invention claimed is:

1. Device for the reception and/or the transmission of multibeam signals of the type comprising on a same substrate:

- several slot printed antennas, the slot antennas being disposed so as to receive an azimuthally wide sector,
- portions of feed line each portion crossing a slot antenna and being connected to means for utilizing the multibeam signals for reception, and
- a second feed line crossing the set of all slot antennas and being connected to the means for utilizing the multibeam signals for transmission.

2. Device according to claim 1, wherein the second feed line crossing the set of all slot antennas consists of a microstrip line or a coplanar line, the length of the line between two slots being equal to $k\lambda m/2$ at the central frequency of operation of the system, and the length of line between one end of the line and a slot being equal to $\lambda m/4$, where $\lambda m=\lambda 0/\sqrt{\epsilon reff.}$ with $\lambda 0$ being the wavelength in vacuo, $\epsilon reff.$ being the equivalent relative permittivity of the feed line, and k being an integer >0.

3. Device according to claim 2, wherein the length of the feed lines between two slots is equal to $k\lambda m$, with $\lambda m=\lambda 0/\epsilon reff.$, $\lambda 0$ being the wavelength in vacuo, $\epsilon reff.$ being the eciuivalent relative permittivity of the feed line, and k being an integer >0.

4. Device according to claim 2, wherein the crossover between the slot of the slot printed antenna and the line is effected, at the central frequency of operation of the system, at a distance $k'\lambda s/4$ from the closed end of the slot with $\lambda s=\lambda 0/\sqrt{\epsilon 1 reff.}$, ~~(~~$\lambda 0$ being the wavelength in vacuo, and $\epsilon 1 reff.$ being the equivalent relative permittivity of the slot~~)~~ and k' being an odd integer.

5. Device according to claim 2, wherein one end of the second feed line is connected to the means for utilizing the multibeam signals.

6. Device according to claim 2, wherein the connection of the feed line to the means for utilizing the multibeam signals is effected on a part between two slots at a distance $k\lambda m/2$ from one of the slots, with $\lambda m=\lambda 0/\sqrt{\epsilon reff.}$, $\lambda 0$ being the wavelength in vacuo, $\epsilon reff.$ being the eciuivalent relative permittivity of the feed line, and k being an integer >0.

7. Device according to claim 1, wherein the portions of feed lines crossing a slot antenna consist of a portion of microstrip line or of coplanar line, each portion crossing the slot of one of the slot printed antennas and being linked to the means for utilizing the multibeam signals by a switching device.

8. Device according to claim 6, wherein the crossover of each portion of a feed line and of the slot printed antenna is effected, at the central frequency of operation of the system, at a distance $k'\lambda s/4$ from the closed end of the slot with $\lambda s=\lambda 0/\epsilon 1 reff.$, ~~(~~$\lambda 0$ being the wavelength in vacuo, $\epsilon 1 reff.$ being the equivalent relative permittivity of the slot~~)~~, and k' being an odd integer.

9. Device according to claim 1, wherein the distance between the feed line constituting the means of connection in transmission and the portion of a feed line constituting one of the means of connection in reception is equal, at the central frequency of operation to the system, to $k''\lambda s/2$ with $\lambda s=\lambda 0/\epsilon 1 reff.$ ~~(~~$\lambda 0$ being the wavelength in vacuo, $\epsilon 1 reff.$ being the equivalent relative permittivity of the slot~~)~~, and k" being an integer >0.

10. Device according to claim 1, wherein each slot is formed on a first face of the substrate, the portions of feed line and the second feed line being made on the second face in order to cross said slot.

11. Device according to claim 10, wherein the slot line flares progressively up to the edge of the substrate.

12. Device according to claim 11, wherein the antenna is of the Vivaldi antenna type.

13. Device according to claim 10, wherein the antennas are regularly disposed about a single and coplanar point, in such a way as to be able to radiate in a 360° angle sector.

* * * * *